US007673492B2

(12) United States Patent
Hough

(10) Patent No.: US 7,673,492 B2
(45) Date of Patent: Mar. 9, 2010

(54) TOOL TO AIDE IN THE BENDING OF REBAR (REINFORCED STEEL BARS) ON CONSTRUCTION SITE

(76) Inventor: Curtis Robert Hough, 2490 Viejo Dr., Lake Havasu City, AZ (US) 86406

( * ) Notice: Subject to any disclaimer, the term of this patent is extended or adjusted under 35 U.S.C. 154(b) by 0 days.

(21) Appl. No.: 12/380,030

(22) Filed: Feb. 24, 2009

(65) Prior Publication Data

US 2010/0024515 A1 Feb. 4, 2010

(51) Int. Cl.
*B21J 13/08* (2006.01)
*B21D 7/02* (2006.01)

(52) U.S. Cl. ..... 72/458; 72/218; 72/388; 72/390.4; 72/390.5

(58) Field of Classification Search ..... 72/218, 72/219, 387, 388, 390.4, 390.5, 389.1, 458
See application file for complete search history.

(56) References Cited

U.S. PATENT DOCUMENTS

| | | | | | |
|---|---|---|---|---|---|
| 268,050 | A * | 11/1882 | Stephens | 72/217 |
| 2,675,723 | A * | 4/1954 | Stein | 72/458 |
| 3,732,721 | A * | 5/1973 | Cusimano | 72/458 |
| 5,878,615 | A * | 3/1999 | Brown | 72/214 |
| 6,318,424 | B1 * | 11/2001 | Elfrink | 72/389.1 |
| 6,418,773 | B1 * | 7/2002 | Tolman | 72/458 |
| 6,865,921 | B2 * | 3/2005 | Simonian | 72/389.1 |

* cited by examiner

*Primary Examiner*—David B Jones
(74) *Attorney, Agent, or Firm*—Schmeiser, Olsen & Watts LLP

(57) ABSTRACT

The invention is a rebar bender that is installed in the trailer hitch of a vehicle and used to bend rebar (up to #5) at any angle and length. The rebar is bent using this tool and the strength of the person bending the rebar.

20 Claims, 2 Drawing Sheets

TOOL TO AIDE IN THE BENDING OF REBAR (REINFORCED STEEL BARS) ON CONSTRUCTION SITE

DRAWING DESCRIPTION

Figure 1:
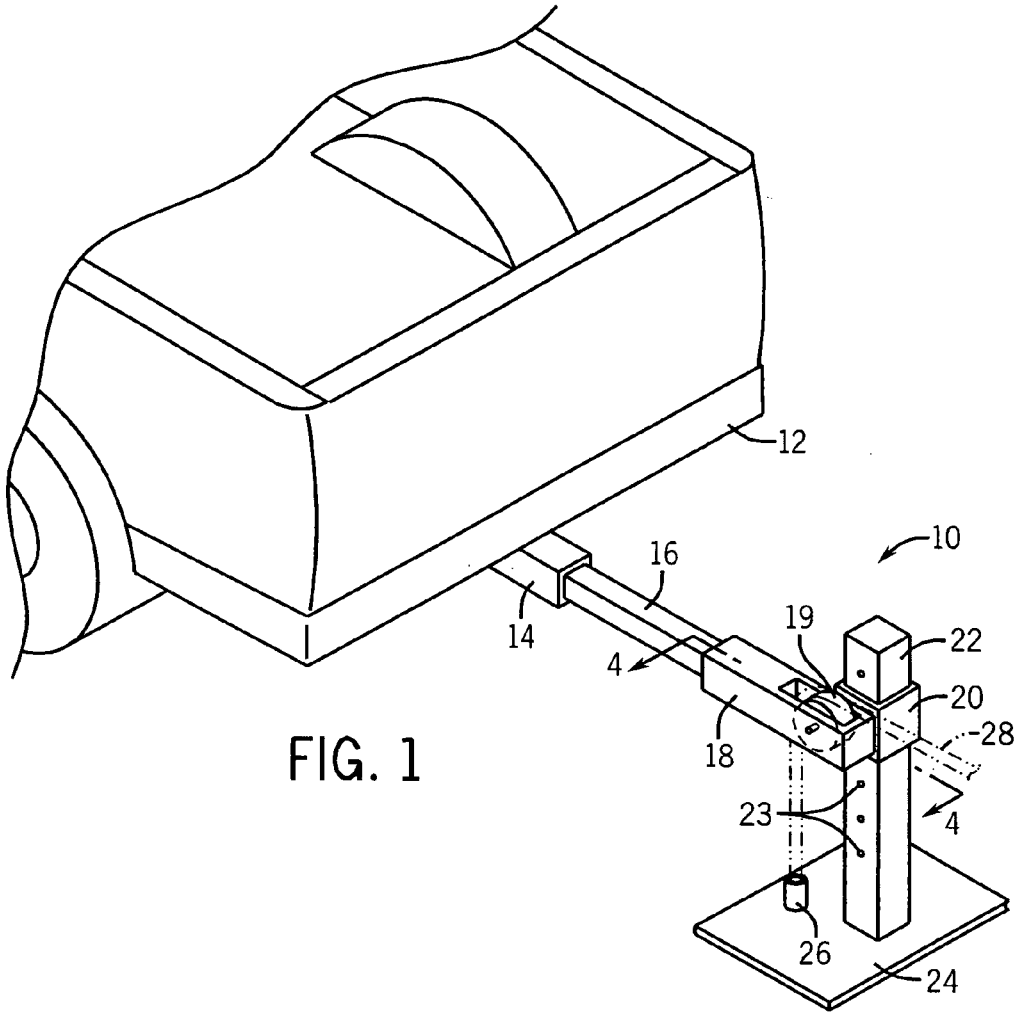

FIG. 1: is a perspective view showing the invention in use.

Figure 2:
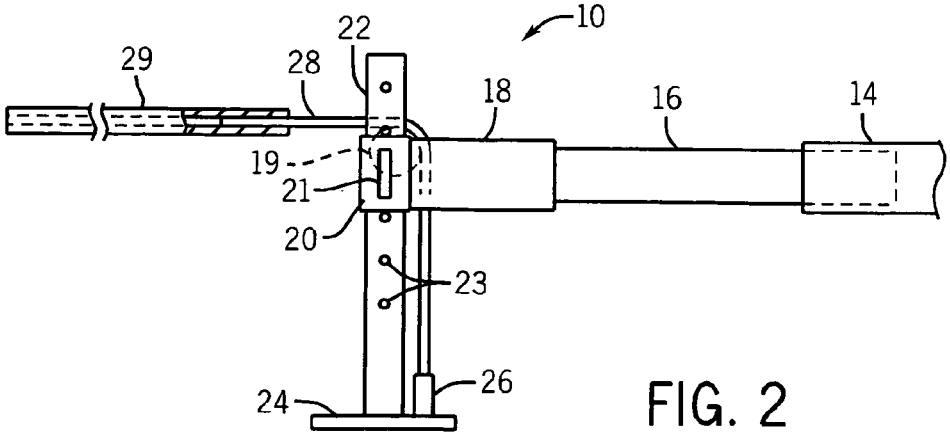

FIG. 2: is a side elevation view.

Figure 3:
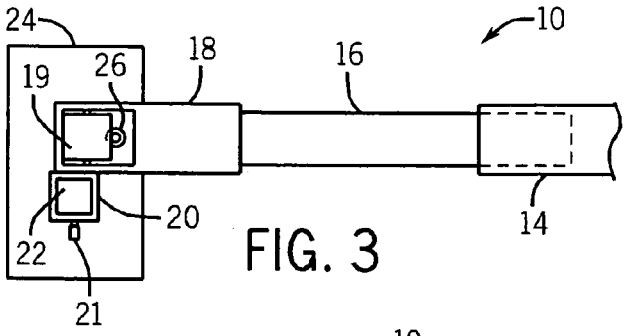

FIG. 3: is a top plan view.

Figure 4:
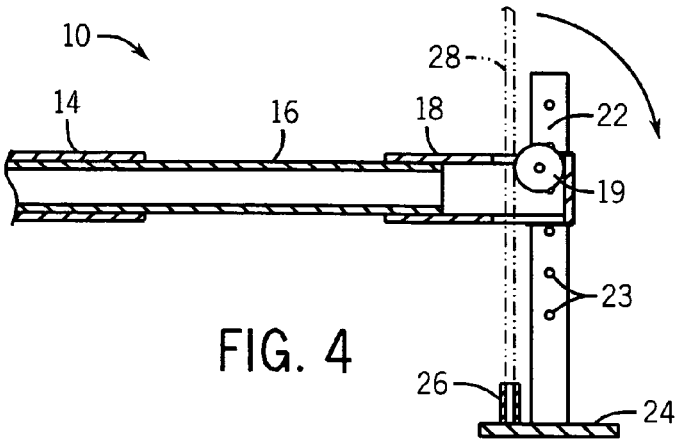

FIG. 4: is a cross-sectional view taken on line 4-4 of FIG. 1.

Figure 5:
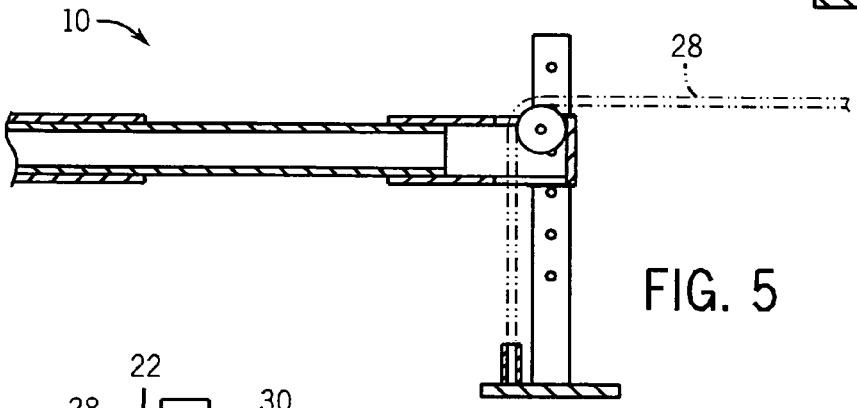

FIG. 5: is a cross-sectional view similar to FIG. 4, showing a rebar piece being bent.

Figure 6:
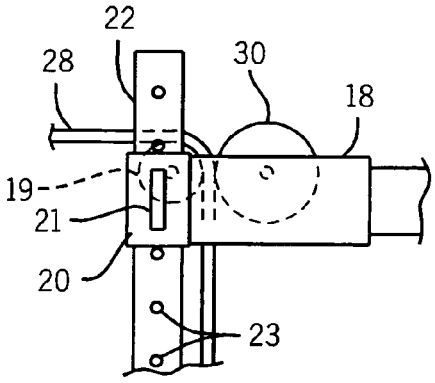

FIG. 6: is a side elevation view of a second embodiment of the invention.

DESCRIPTION LIST

10: is the overall invention of a hitch-mounted rebar bender.
12: is the rear of a truck.
14: is the hitch receiver of truck 12.
16: is the hitch tube of the invention.
18: is the horizontal member.
19: is the roller.
20: is the adjustable mounting.
21: is the adjustment pin.
22: is the vertical member.
23: are the adjustment holes in vertical member 22.
24: is the base.
26: is the rebar socket.
28: is the rebar.
29: is the pipe handle which slides over rebar 28 to enhance bending force.
30: is an auxiliary roller for use in bending larger diameters of rebar 28.

DESCRIPTION

The present invention relates to a tool to aide in the bending of rebar (reinforced steel bars) on construction site. The invention is comprised of steel. There is the part that goes into a hitch which can differ based on the size of the hitch. This is made from a 14" long piece of steel which is 2×2 inches square.

At the end of this piece there is a welded on rectangle (4.75"×2.5").

In the middle of this rectangle there is a cylinder welded into the middle which has tow rollers fastened to the middle of it.

Each roller is approximately 1.5" in diameter.

The space between the roller and the hitch; and the size of a rectangle can vary based on size of tool needed.

Attached to the left side of the rectangle/hitch there is 1.5" by 1.5" square welded onto the frame.

Attached to top of this square is and adjustable clamp with spring and bolt tensioner.

There is then another piece which is used as the guide for the rebar. It is made out of welded steel also.

There is support frame which is 1.25"×1.25" which is 14.15 inches in length.

It is welded onto a 7⅜"×4" sheet of steel used to hold the rebar in place.

Finally there is a cylinder used to support the beam which is dependent on the size of the rebar the tool is being built for. This is also welded to the sheet of steel.

The components work together according to the following steps:

(1) The hitch portion of the tool goes into the hitch of any vehicle that has a trailer hitch setup. This varies from Class I hitches to Class V hitches.

(2) The consumer then takes the rebar and places it between the hole in the hitch and the cylinder in the middle of the rectangle described above. The rebar then sits down into the cylinder made to aide in the bending of the bar.

(3) The guide rail is then adjusted using the spring tensioned clamp to the height that the customer wants the bend to be.

(4) The rebar is then placed against the rollers and pulled on until the correct angle of the bend is achieved that the customer wants in their rebar.

The invention could also be used to bend other types of metal and rods used in the construction of a house or for landscaping. This tool could also be used for bending of conduit for electrical work.

The item could be created with different pre-set angles on the item to allow for more precise angle creation. Also the adjustable trailer hitch could be placed in a fixed position so that the length would be set when purchasing the item.

What is claimed is:

1. A tool for bending a metal bar comprising:

a socket attached to a base, wherein the socket secures a metal bar first end in response to the metal bar first end being placed in the socket;

a vertical member with a vertical member first end attached to the base, and a vertical member second end opposed to the vertical member first end;

a horizontal member with a horizontal member first end coupled to a trailer hitch, and a horizontal member second end coupled to the vertical member;

an opening in the horizontal member, wherein the opening is positioned vertically above the socket; and a first roller mounted in the opening, wherein the metal bar contacts the first roller at a point of contact along a length of the metal bar in response to the metal bar passing through the opening in order to insert the metal bar first end into the socket, wherein the metal bar is bent at the point of contact in response to pressure applied to a metal bar second end.

2. The tool of claim 1, wherein the horizontal member comprises a first and a second horizontal member piece adjustably coupled together, wherein the length of the horizontal member changes in response to adjusting the coupling of the first and second horizontal member pieces.

3. The tool of claim 1, further comprising a second roller mounted in the opening, wherein the metal bar passes between the first and the second roller.

4. The tool of claim 1, further comprising:

a plurality of holes in the vertical member;

a pin mounted to the horizontal member which couples to one of the plurality of holes in the vertical member, wherein the horizontal member is coupled to the vertical member in response to coupling the pin to one of the plurality of holes.

5. The tool of claim 4, wherein the location of the bend in the metal bar is moved along the length of the metal bar in response to changing which of the plurality of holes the pin couples the horizontal member to.

6. The tool of claim 1, further comprising:

a handle repeatably, removeably coupled to the metal bar second end, wherein the handle is used to apply pressure to the metal bar second end.

7. The tool of claim 6, wherein the handle is hingedly attached to the horizontal member.

8. A tool comprising:

a horizontal square tube comprising a horizontal square tube first end coupled to a trailer hitch, a horizontal square tube second end coupled to a vertical square tube, and a horizontal square tube length;

a hole passing vertically through the horizontal square tube length;

a first roller mounted in the hole; and a socket attached to a base positioned below the hole, wherein a pliable rod with a pliable rod first end, a pliable rod second end opposing the pliable rod first end, and a pliable rod length passes through the hole, contacting the first roller at a point of contact along the pliable rod length in response to the pliable rod first end being inserted into the socket;

wherein a bend is placed in the pliable rod at the point of contact in response to pressure applied to the pliable rod second end.

9. The tool of claim 8, wherein an end of the vertical square tube is attached to the base.

10. The tool of claim 8, wherein the horizontal square tube is coupled to the trailer hitch using a hitch tube.

11. The tool of claim 8, further comprising:

a plurality of holes along a length of the vertical square tube, wherein the horizontal square tube can be repeatably coupled to any of the plurality of holes.

12. The tool of claim 11, wherein the location of the bend in the pliable rod is moved in response to changing which of the plurality of holes the horizontal square tube is coupled to.

13. The tool of claim 8, wherein the trailer hitch can be of a size in the range of a Class I trailer hitch size to a Class V trailer hitch size.

14. The tool of claim 8, wherein a second roller is mounted in the hole, wherein the pliable rod passes between the first roller and the second roller.

15. The tool of claim 8, wherein the horizontal square tube and the vertical square tube are composed of steel.

16. A method of bending a piece of rebar comprising:

coupling a hitch-mounted rebar bender to a trailer hitch;

placing a first end of a piece of rebar through a hole in the hitch-mounted rebar bender, wherein the piece of rebar passes alongside a roller mounted in the hole;

inserting the first end of the piece of rebar into a socket, which secures the first end of the piece of rebar;

adjusting the distance from the roller to the socket using a spring-tensioned clamp; and applying pressure to a second end of the piece of rebar, wherein the piece of rebar bends at the roller in response to applying pressure to the second end of the piece of rebar.

17. The method of claim 16, wherein the angle of the bend placed in the rebar is adjustable.

18. The method of claim 16, wherein adjusting the distance from the roller to the socket adjusts the position of the bend placed in the piece of rebar.

19. The method of claim 16, further comprising:

attaching a handle to a second end of the piece of rebar.

20. The method of claim 16, further comprising:

adjusting the length of a coupler used to couple a hitch-mounted rebar bender to a trailer hitch.

* * * * *